US005241999A

United States Patent [19]

Fulghum, Jr. et al.

[11] Patent Number: 5,241,999

[45] Date of Patent: Sep. 7, 1993

[54] INFEED CHUTE WITH WINGS FOR DUAL CRANES

[76] Inventors: Oscar T. Fulghum, Jr.; A. Neil Rogers, both of c/o Fulghum Industries, Inc., P.O. Box 909, Wadley, Ga. 30477

[21] Appl. No.: 892,949

[22] Filed: Jun. 4, 1992

[51] Int. Cl.[5] ..... B27L 1/00

[52] U.S. Cl. ..... 144/208 B; 144/341; 193/2 R

[58] Field of Search ..... 193/2 R, 3; 414/397; 144/208 B, 341; 198/750

[56] References Cited

U.S. PATENT DOCUMENTS

| | | | |
|---|---|---|---|
| 850,132 | 4/1907 | Buxton . | |
| 1,148,136 | 7/1915 | Alfsen . | |
| 1,768,247 | 6/1930 | Gardner . | |
| 2,943,656 | 7/1960 | Wakeman . | |
| 3,948,300 | 4/1976 | Young | 144/208 B |
| 4,369,823 | 1/1983 | Gustafsson . | |
| 4,396,048 | 8/1983 | Dubey . | |
| 4,445,558 | 5/1984 | Banner . | |
| 4,690,187 | 9/1987 | Schmidt . | |
| 5,044,412 | 9/1991 | Price et al. | 144/208 B |
| 5,063,981 | 11/1991 | Jonkka | 144/208 B |

*Primary Examiner*—W. Donald Bray

*Attorney, Agent, or Firm*—Cushman, Darby & Cushman

[57] ABSTRACT

An infeed chute for a debarking drum is provided which is adapted to accommodate infeed from two log cranes simultaneously or nearly simultaneously. The chute has a central feed plate of relatively small width and trough plates of relatively great width and at a gentle slope, thereby to provide a smoothly and slightly inclined trough. Furthermore, wing plates are provided which not only define containing side walls but continue and extend the trough width to receive a plurality of log loads and yet smoothly guide the same towards a common inlet. Desirably, to accommodate the gentle slope and increased width of the chute assembly, three transition plates are provided adjacent the debarker inlet to round out the flow thereinto.

10 Claims, 13 Drawing Sheets

INFEED CHUTE WITH WINGS FOR DUAL CRANES

BACKGROUND OF THE INVENTION

1. Field of the Invention

The invention relates to an infeed chute for a debarking drum and, in particular, to an infeed chute designed to accommodate two log cranes for simultaneous or near simultaneous feed from both cranes.

2. Description of the Related Art

A variety of systems have heretofore been provided for delivering logs to the inlet end of a debarking drum. One conventional method of delivery is to provide an infeed chute for receiving logs from a log crane and guiding those logs end first into the debarking drum.

A concern with all infeed chute systems is that the chute guide the logs into the debarking drum in a manner so that the logs do not bind or clog at the drum inlet so that there is a smooth, relatively continuous infeed into the debarking drum and so that there is effective debarking of the logs with a minimal risk that the logs being infed will be whipped around and pieces thereof ejected from the infeed chute, which would endanger workers in the area.

A typical log crane 10 and infeed chute 12 are shown by way of example in FIG. 1. As shown, the logs which in the illustrated configuration are tree-length are stored in a storage pile 14, which may be circular, as shown. The storage pile 14 is interrupted to accommodate the infeed chute 12 and debarking drum 16 substantially along the path defined by the storage pile and also to allow log trucks 18 to bring logs to the vicinity of the storage pile 14 so that the log crane 10 can remove logs from such trucks 18 and store the same in the storage pile 14.

The log crane 10 is provided to retrieve logs from the storage pile 12, carry the load of logs to the infeed chute 14 and release that load of logs downwardly and into the debarking drum 16. Thus, infeed into the drum is limited to a sequence of loads, the size of which is determined by the capacity of the log crane 10. Furthermore, feed of logs is interrupted as the log crane 10 is used to locate, retrieve and convey logs from the storage pile 12 to the infeed chute 14. Thus, such prior art log crane/infeed chute systems were limited by the capacity of the log crane and the time required to retrieve logs from storage pile and convey the same to the infeed chute.

In order to ensure that the logs are smoothly guided into the debarking drum 16, the infeed chute 12 has a width only slightly greater than the inlet to the debarking drum 16 (FIG. 1) and, like a funnel, guides the logs into the debarking drum 16. More particularly, a top plan view of the conventional chute of FIG. 1 is shown in FIG. 2. As can be seen, a central plate 20 of about two-thirds the diameter of the debarking drum passes centrally down the length of the infeed chute 12. Two substantially triangular plates 22 are disposed on either side of the central plate 20 to define trough walls at the inlet end of the chute 12 as shown in FIG. 3. The trough walls 22 have a width equal to about one half the diameter of the drum 16 at the inlet end of the chute (FIG. 3). The trough walls are defined at an angle A of greater than about 155 and less than about 165 degrees with respect to the central plate 20.

Another pair of triangular plates 24 are defined along a substantial portion of the trough to define severely sloping side walls to more steeply guide the logs into the debarking drum 16, as shown in FIG. 4. In this view, it can be seen that angle A remains between 155 and 165 degrees whereas angle B, defined between each plate 24 and respective plate 22, is greater than about 115 and less than about 125 degrees.

As shown in FIG. 5, as the debarking drum is approached, the trough walls or plates 22 have become quite narrow and the severely sloping side walls 24 define a substantial portion of the trough thereby concentrating the logs in the center of the chute to deliver the same into the debarking drum 16. Here again, angle A is greater than about 155 and less than about 165 degrees and angle B is greater than about 115 and less than about 125 degrees.

Adjacent the debarking drum inlet, as can best be seen in FIGS. 6 and 2, two plate segments 26,28 are mounted on each side of and to the central plate 20, trough wall plates 22 and vertical side wall plates 24, to define a transition to the debarking drum inlet. Specifically, a triangular plate 26 is mounted to the cut away distal end of central plate 20 and four sided plate 28 is mounted or coupled to the triangular plate 26, trough plate 22 and side wall 24. As shown in FIG. 6, plates 26 and 28 round out the trough immediately adjacent the inlet of the debarking drum to guide the logs thereinto.

Thus, the illustrated single crane infeed chute 12 is relatively narrow and provides a generally uniformly deepening trough with containing side walls 24 and very gradually narrowing trough walls 22 to guide the logs into the debarking drum. The capacity of that infeed chute, however, is limited to the intermittent single crane load, as described above. Debarking drums, on the other hand, are not necessarily so limited to such an intermittent, relatively small load. Indeed conventional debarking drums can receive a greater load and more continuously. In addition, debarking drums can be fairly readily scaled up to have a greater diameter and/or greater length to accommodate a greater log flow.

In order to maximize the amount of wood which can be processed in a chip mill during a given period of up or operational time, it would be desirable to increase the rate at which logs are infed into a debarking drum of either conventional or increased capacity. The efficiency of the infeed chute system described above may be increased by providing two log cranes operating in tandem to thereby reduce the delay experienced when a single crane retrieves another load of logs to be infed. However, such a second crane must wait until the first load of logs has been fully or substantially received into the debarking drum to ensure that the logs will not bind at the drum inlet because the above described conventional infeed chute is designed to accommodate only a single load of logs.

SUMMARY OF THE INVENTION

It is an object of the present invention to provide a more efficient chipping assembly wherein the infeed of logs to the debarking drum is maximized by providing an infeed chute which allows dual cranes to simultaneously or nearly simultaneously deliver logs whereby full advantage can be taken of the capacity of a single debarking drum and the delay which necessarily results from retrieval of loads by the cranes can be minimized by concurrent crane operation. Thus, the infeed chute of the invention which is designed to accommodate two log cranes by receiving loads from two log cranes simultaneously or nearly simultaneously, allows delivery of a second load to the infeed chute with out a binding of the logs at the debarking drum inlet.

To achieve the foregoing object, an infeed chute for a debarking drum as provided which has a width at the uppermost, inlet edge thereof substantially greater than conventional infeed chutes but which has a series of funneling plates which smoothly guide logs deposited thereon towards the single debarking drum inlet in a manner which minimizes ejection of logs or portions of logs and binding of logs at the inlet to the conveyor.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings, all of which form a part of this specification.

DETAILED DESCRIPTION OF THE PRESENTLY PREFERRED EXEMPLARY EMBODIMENT

Figure 7:
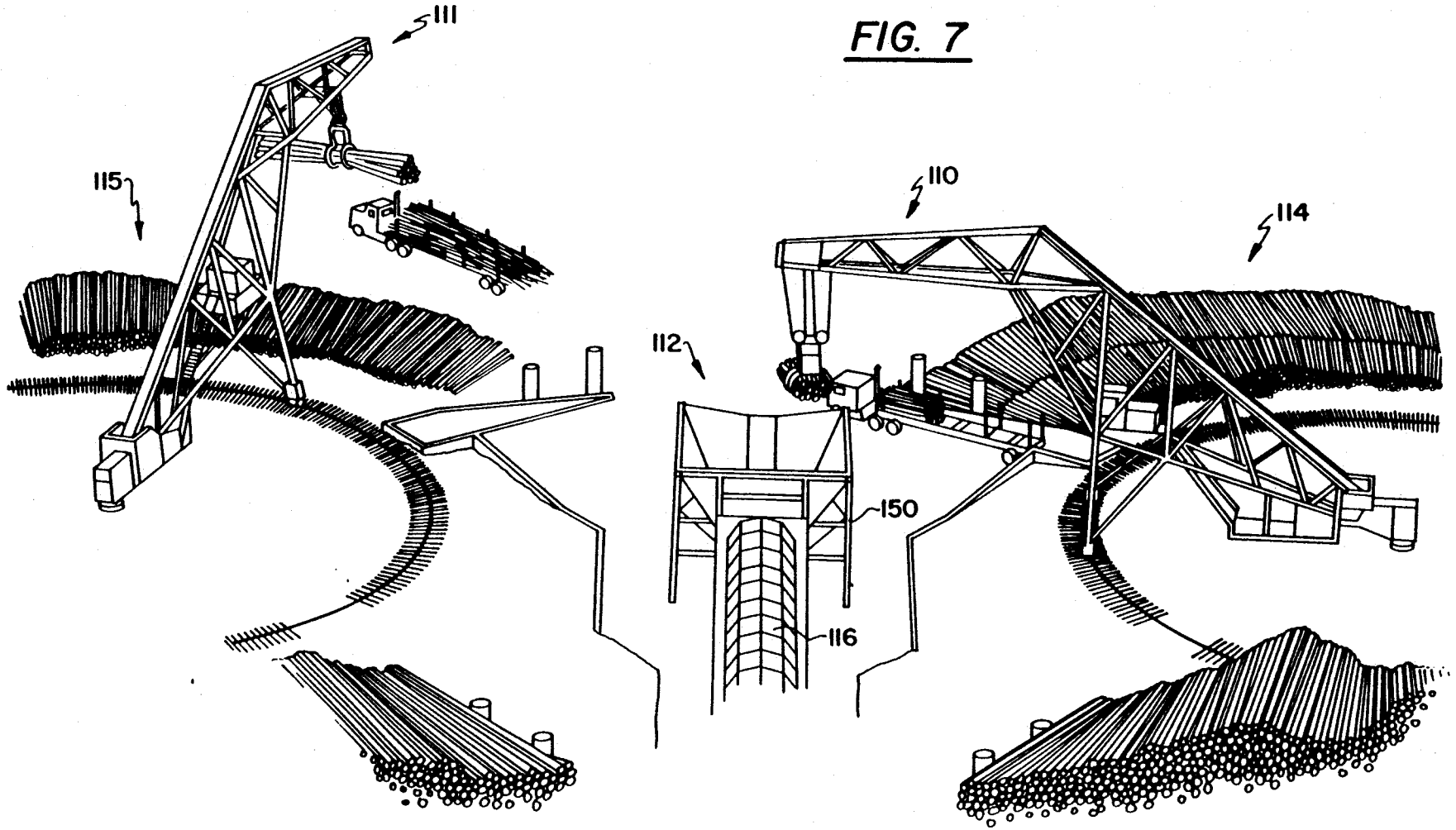
FIG. 7 is a partial, schematic, perspective view of a chip mill having an infeed chute with wings for dual cranes in accordance with the invention.

An infeed chute 112 is provided in accordance with the present invention which can receive logs transported thereto from two log cranes simultaneously or nearly simultaneously (FIG. 7) whereby the full capacity of the associated debarking drum 116 can be used to thereby increase the efficiency of the debarking and chipping apparatus as a whole. The ability to receive simultaneous or near simultaneous loads not only allows the full capacity of the debarking drum 116 to be used to maximize the efficient use of power and time but also reduces production delay which would otherwise result from interrupted feed as a further load is retrieved by a single crane.

Thus, immediately as one crane 110 deposits its load in the chute 112, it can be moved to retrieve another load from its storage pile 114. As that crane is moving from the locus of the chute 112, the second crane 111 can be depositing its load in the chute 112 of the invention. As those near simultaneous loads are being guided into the debarking drum 116 and received in the debarking drum, the first crane 110 which has retrieved another load and is returned to the chute 112. At that time its load can be received in the chute 112 even in the event that the original two near simultaneous loads are being fed into the debarking drum 116. Likewise, the second crane 111 soon returns to the locus of the chute 112 from its storage pile 115 and can deposit its next load. Thus, the infeed chute of the invention can receive crane loads simultaneously or near simultaneously and can subsequently receive further loads without significant ejection of logs or log pieces and without binding thereby maximizing the efficiency of the system as a whole.

In order to receive and accommodate such significant and repeated loading, the infeed chute 112 includes wings shown generally at 118 which ensure that the loads can be received from the two cranes 110, 111 without the cranes 110, 111 interfering with one another and yet ensures that the deposited logs are smoothly guided downwardly into the debarking drum 116.

The novel structure of the invention can thus be appreciated by a comparison of the inventive infeed chute 112 with the conventional chute 12 of FIGS. 1-6. To accommodate plural loads, the infeed chute 112 of the invention, as compared to the prior art infeed chute 12 of FIGS. 1-6 is not simply increased by 100% at the inlet and maintained the same at the outlet. On the contrary, in accordance with the invention the central infeed flow plate 120 is decreased in width as compared to the prior art central flow plate 20. Indeed, the central infeed plate 120 of the invention has a width of about one-half of the debarking drum inlet as opposed to a width of about two-thirds of the debarking drum inlet as was the case with the conventional chute 12. The trough plates 122 on the other hand, in accordance with the invention, have a width at the uppermost, inlet end of the chute 112 significantly greater than the trough plates 22 of the single crane chute 12. In the illustrated embodiment, the trough plates have a width of about 1.2 times greater than the width of the debarking drum inlet.

Providing a narrower central flow plate 120 and significantly wider trough plates 122, it has been discovered, provides a smoothly sloping trough which guides the logs deposited thereon towards the inlet of the debarking drum 116 without abrupt transitions and the attendant risk of binding.

Figure 1:
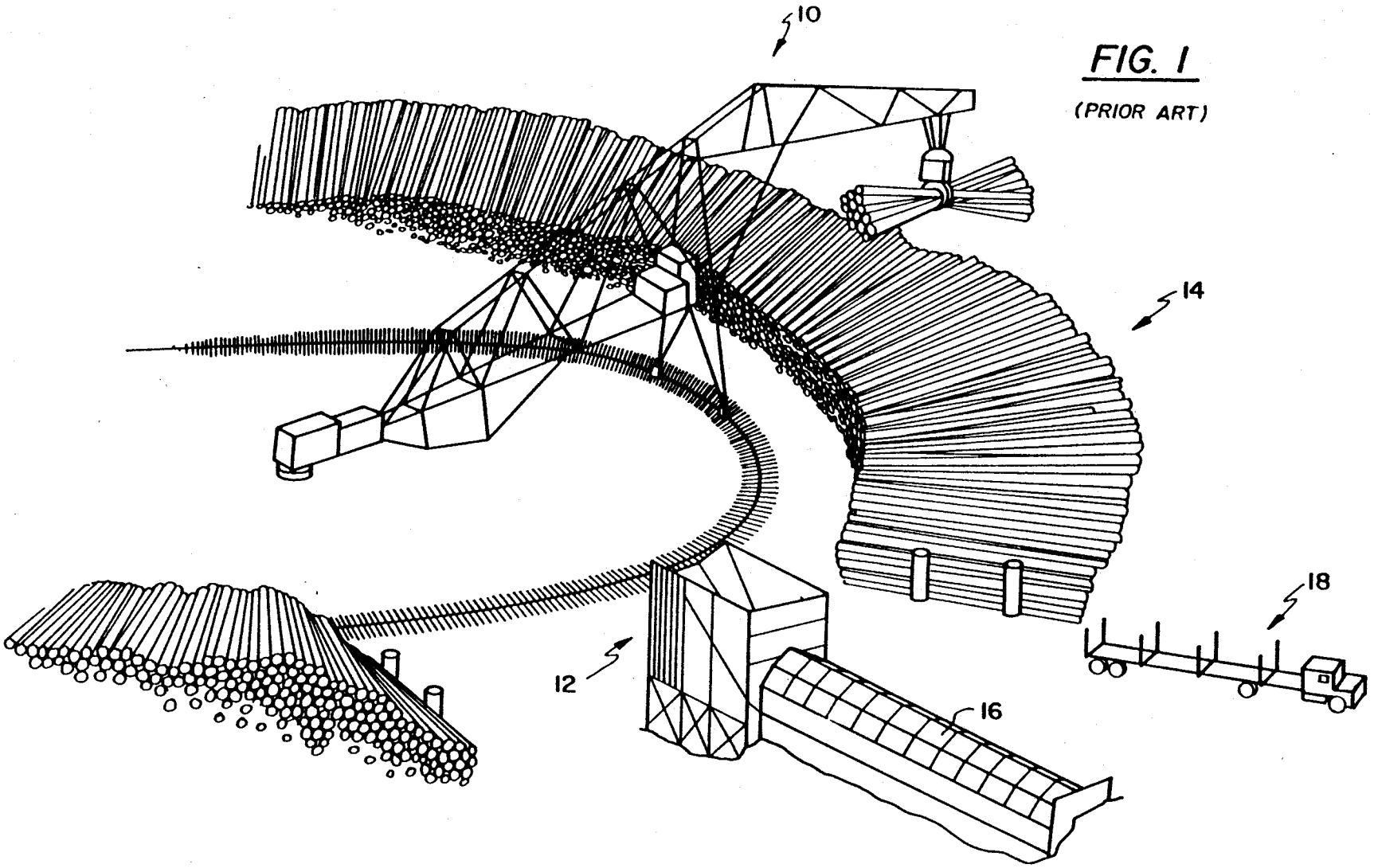
FIG. 1 (PRIOR ART)
FIG. 1 is a partial, schematic, perspective view of a conventional single log crane chip mill.
Figure 2:
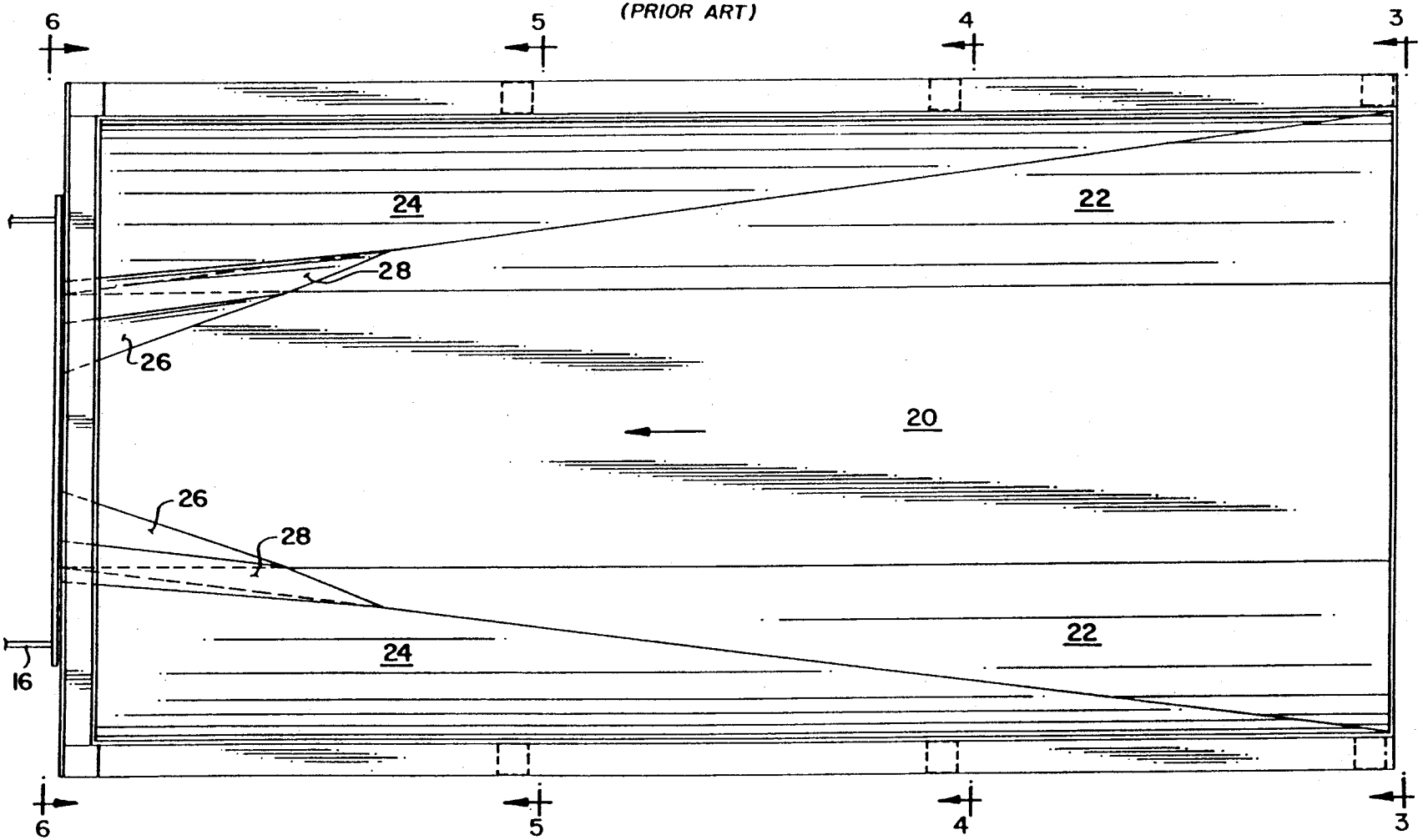
FIG. 2 (PRIOR ART)
FIG. 2 is a top plan view of a conventional single log crane infeed chute.
Figure 3:
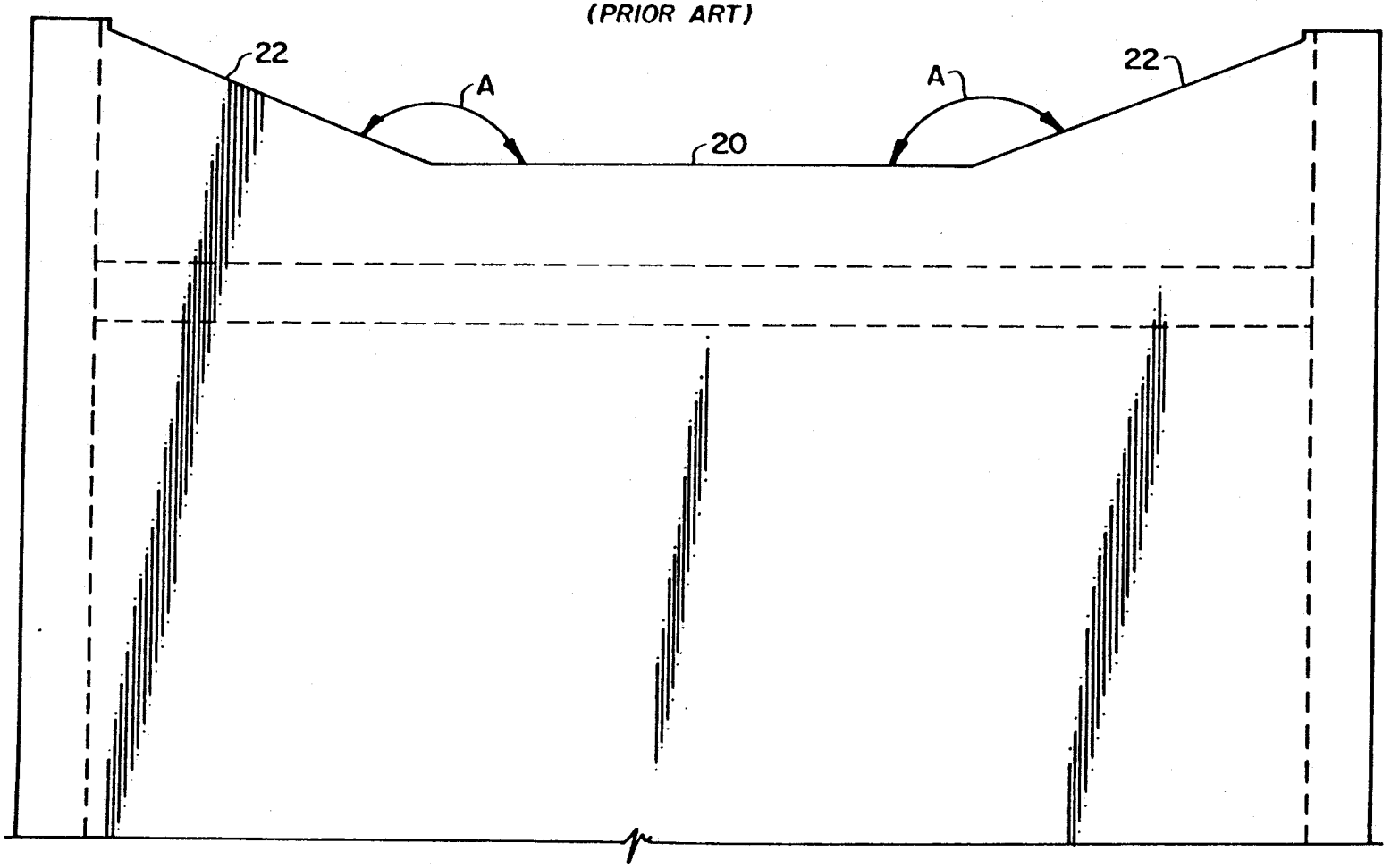
FIG. 3 (PRIOR ART)
FIG. 3 is a cross-sectional view, with the support frame broken away for clarity, taken along line 3—3 of FIG. 2.
Figure 10:
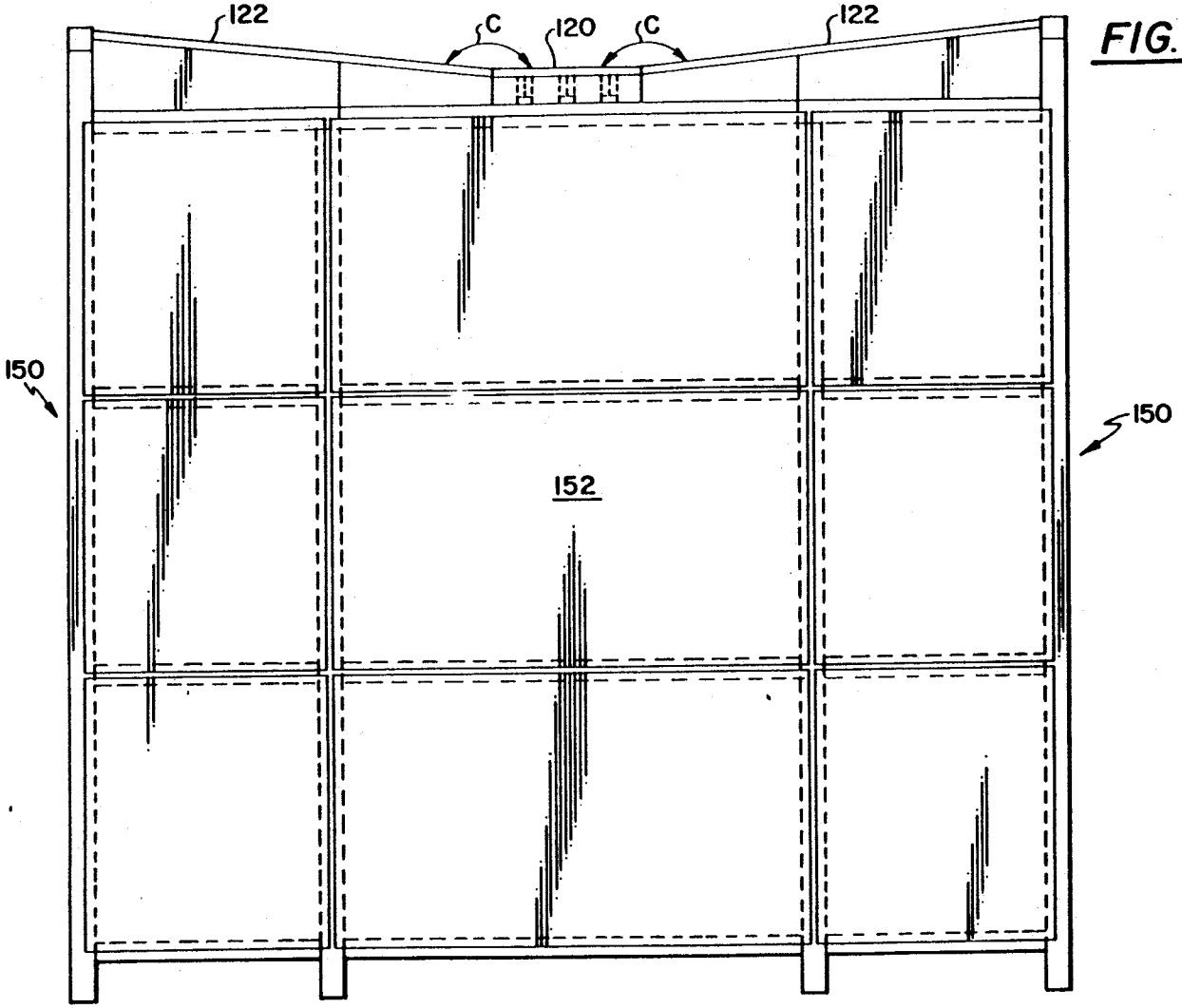
FIG. 10 is a cross-sectional view taken along line 10—10 of FIG. 9.

Contrasting FIG. 10 with FIG. 3, furthermore, it can be seen that the combination of central plate 120 and trough plates 122 defines a more smoothly sloping structure for receipt of the logs. Thus the angle C described by the trough plates 122 and the central plate 120 is greater than 165 degrees and most preferably between about 170° and 175°.

Figure 4:
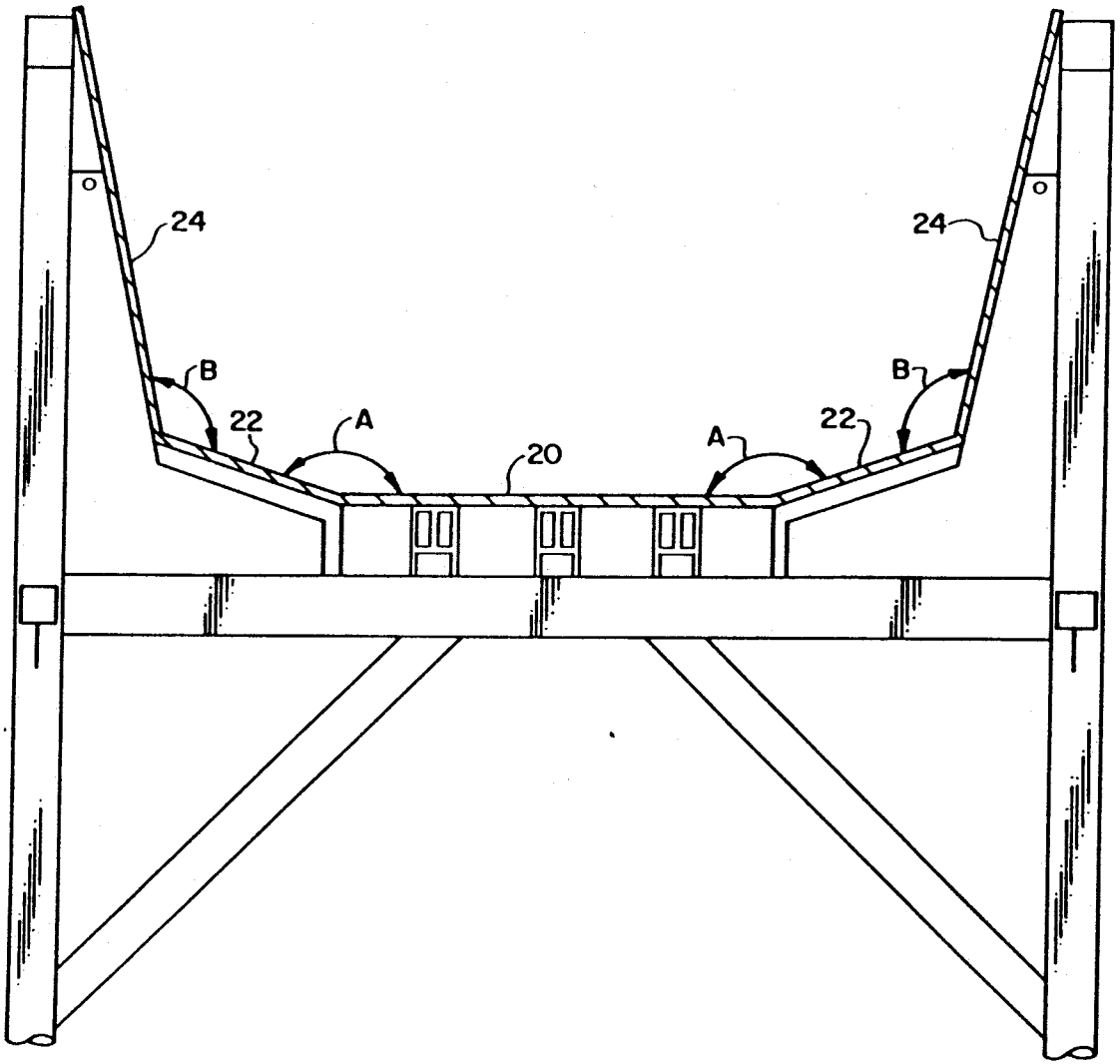
FIG. 4 (PRIOR ART)
FIG. 4 is a cross-sectional view, with the support frame broken away for clarity, taken along line 4—4 of FIG. 2.
Figure 11:
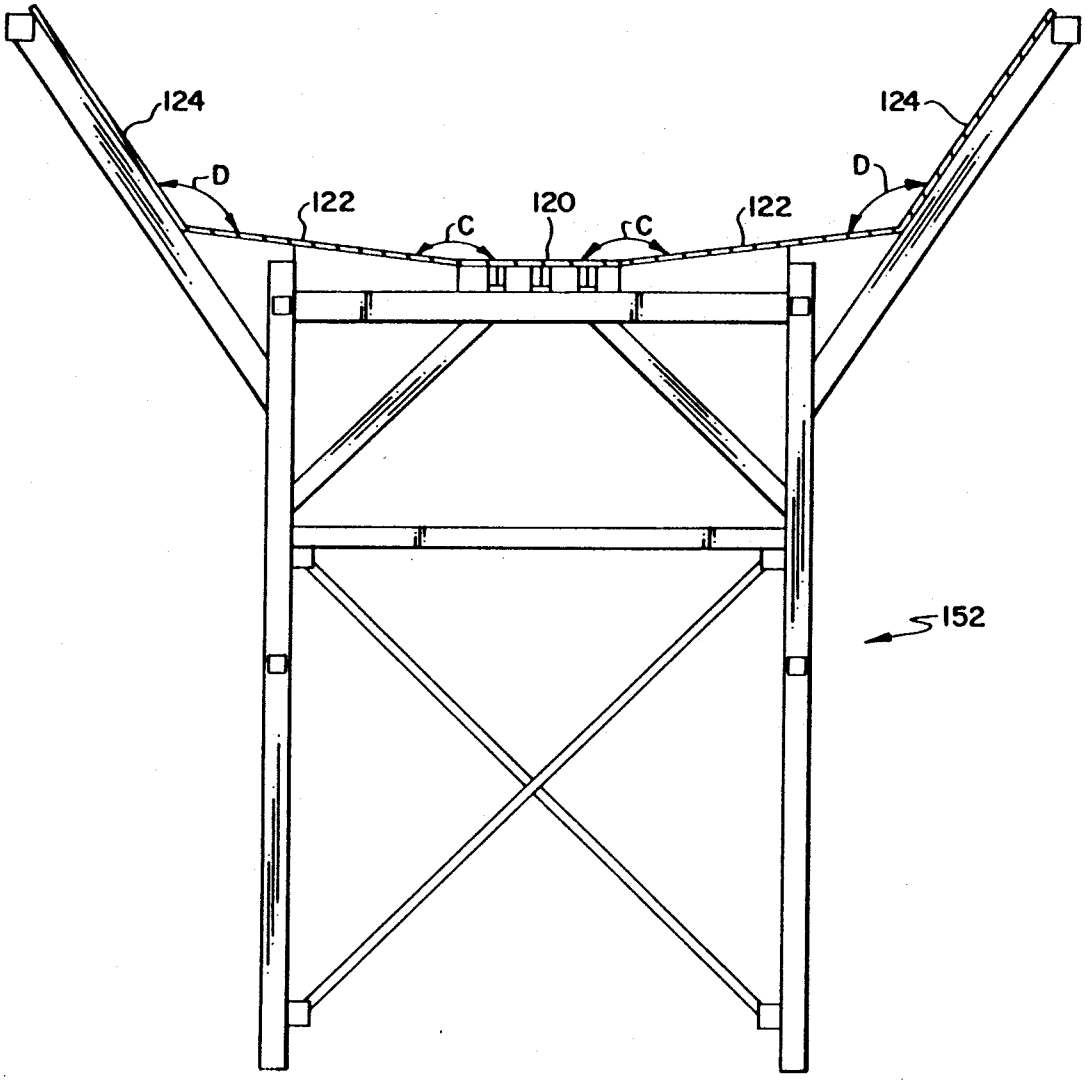
FIG. 11 is a cross-sectional view taken along line 11—11 of FIG. 9.

Contrasting FIG. 11 with FIG. 4, it can be seen that the assembly of the invention continues to define a smoothly sloped central plate and trough plate assembly, with angle C most preferably in the range of 170°-175°. The wing plates 124 of the inventive assembly, furthermore, have a lesser slope than their counterparts in the prior structure. Indeed, in accordance with the invention an angle D of about 125° to about 140° has been found advantageous. The lesser slope again encourages a smooth transition for the logs as they are fed downwardly towards the inlet of the debarking drum 116.

Figure 5:
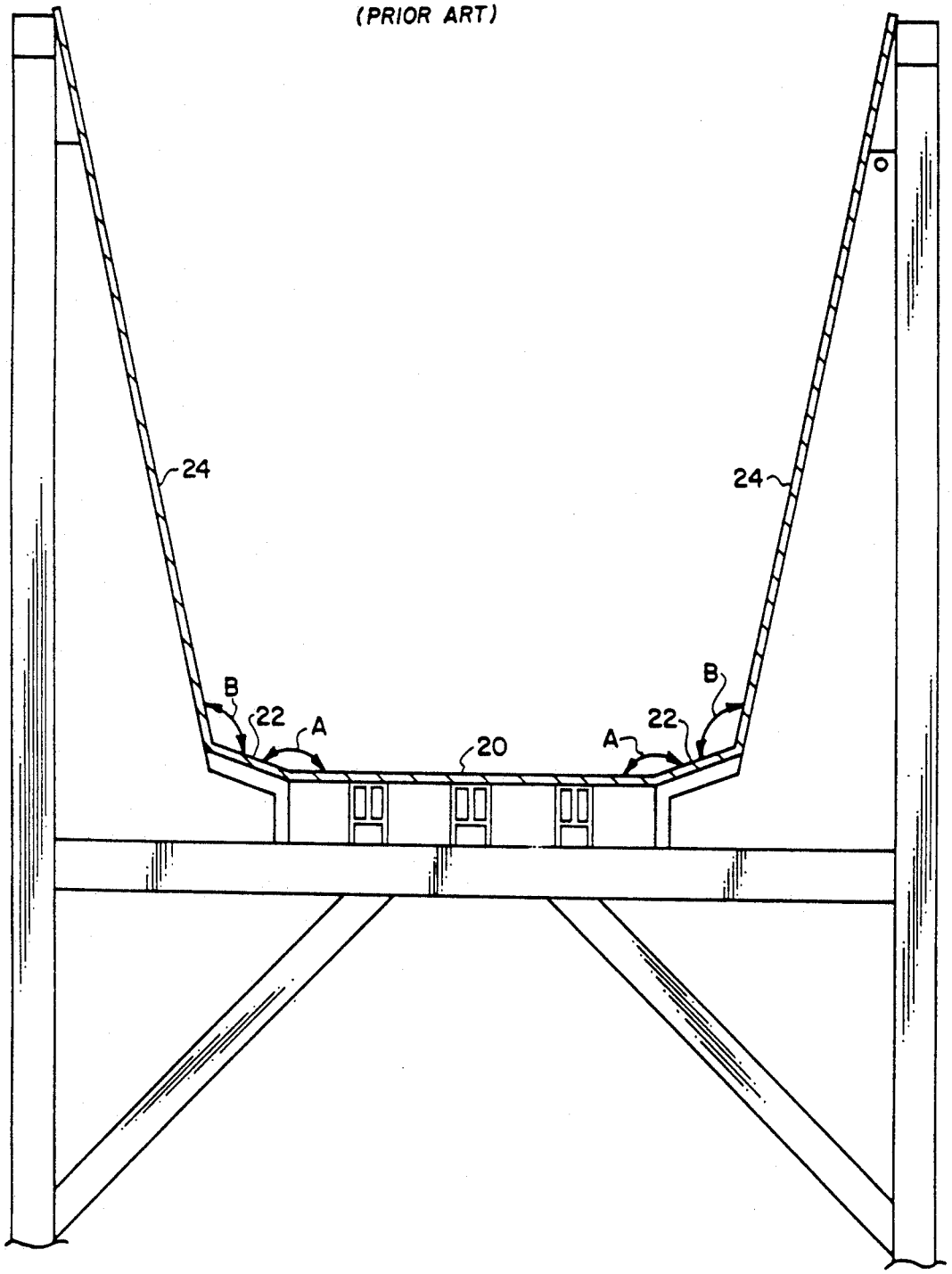
FIG. 5 (PRIOR ART)
FIG. 5 is a cross-sectional view, with the support frame broken away for clarity, taken along line 5—5 of FIG. 2.
Figure 6:
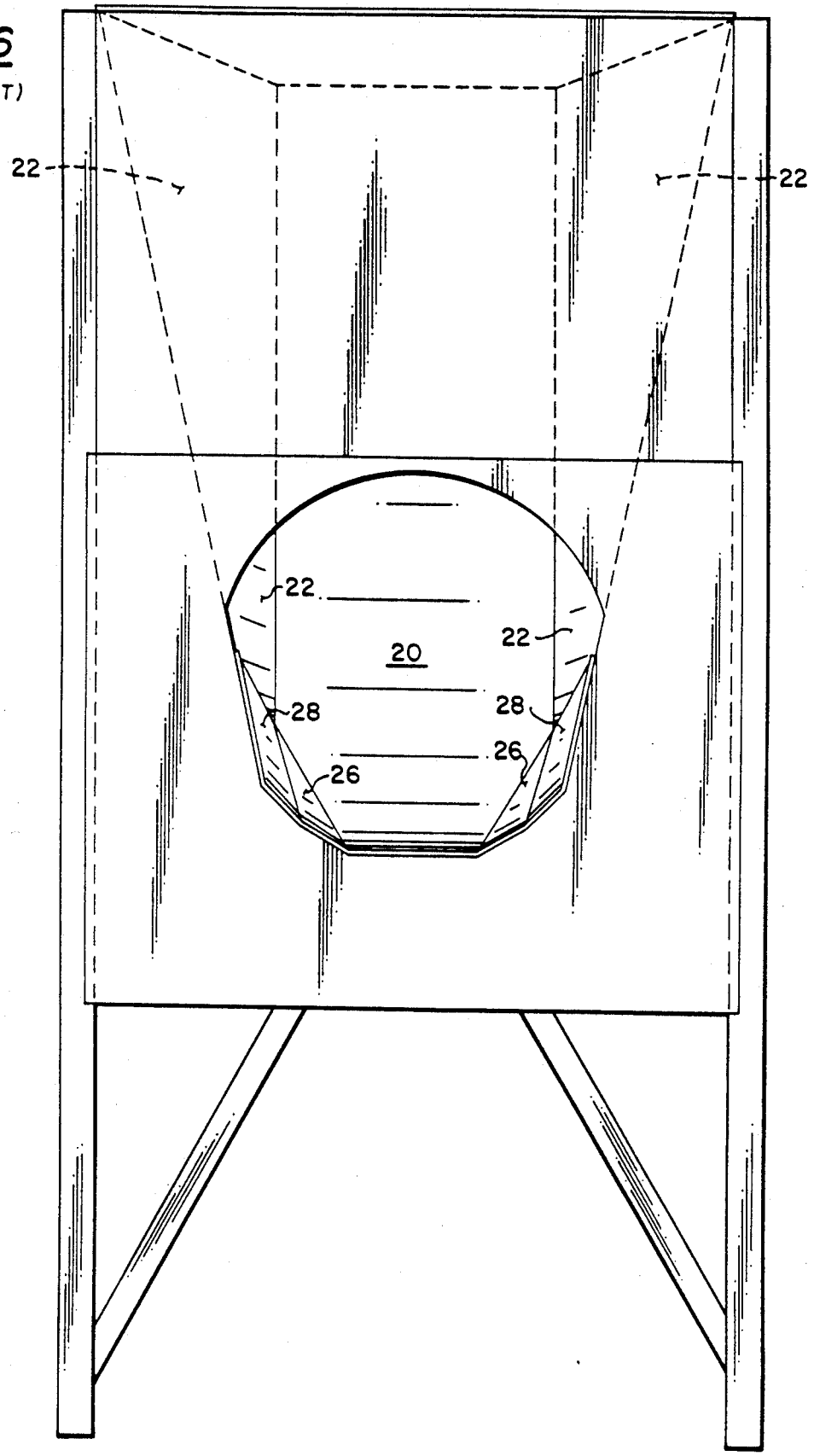
FIG. 6 (PRIOR ART)
FIG. 6 is a cross-sectional view, with the support frame broken away for clarity, taken along line 6—6 of FIG. 2.
Figure 12:
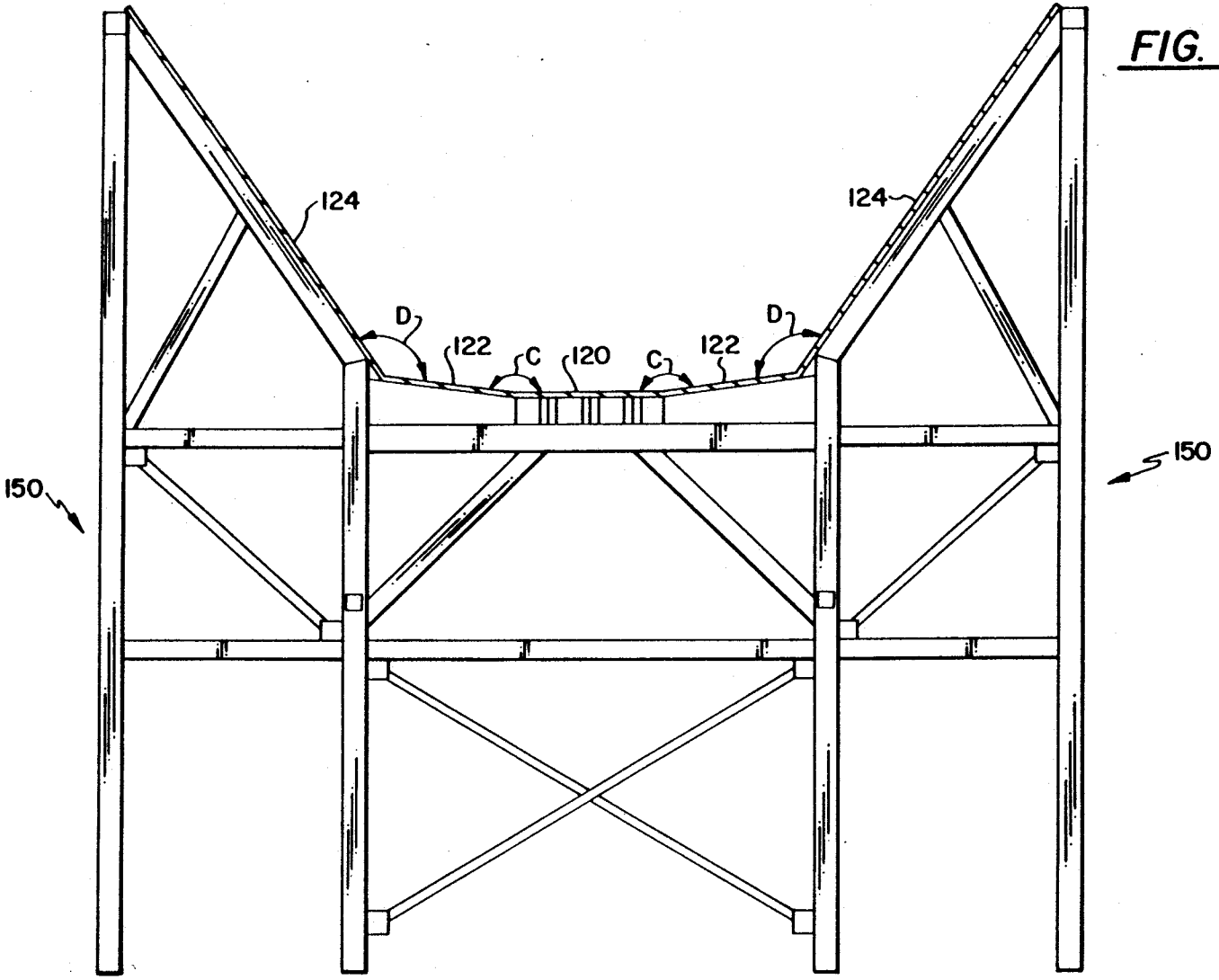
FIG. 12 is a cross-sectional view taken along line 12—12 of FIG. 9.

Contrasting FIG. 5 with FIG. 12, it can be seen, furthermore, that as the inlet of the debarking drum is approached, the side walls 24 of the conventional assembly extend nearly vertically, whereas in accordance with the invention wing walls 124, trough walls 122 and central plate 120 define a more open trough which has a lesser slope, allowing a larger number of logs to be received while encouraging movement of such logs into the debarking drum 116.

Figure 9:
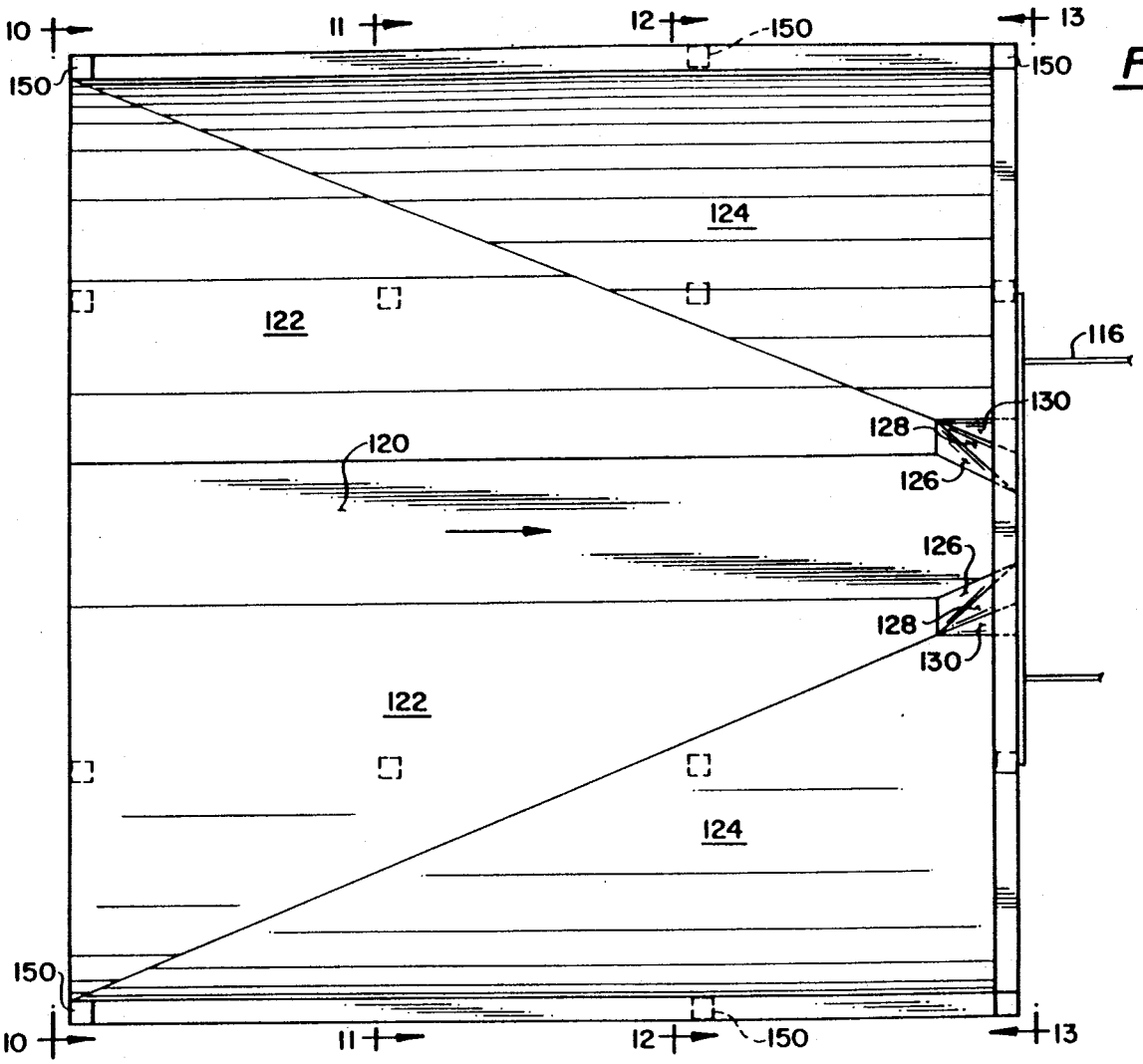
FIG. 9 is a top plan view of the infeed chute with wings for dual cranes in accordance with the invention.
Figure 13:
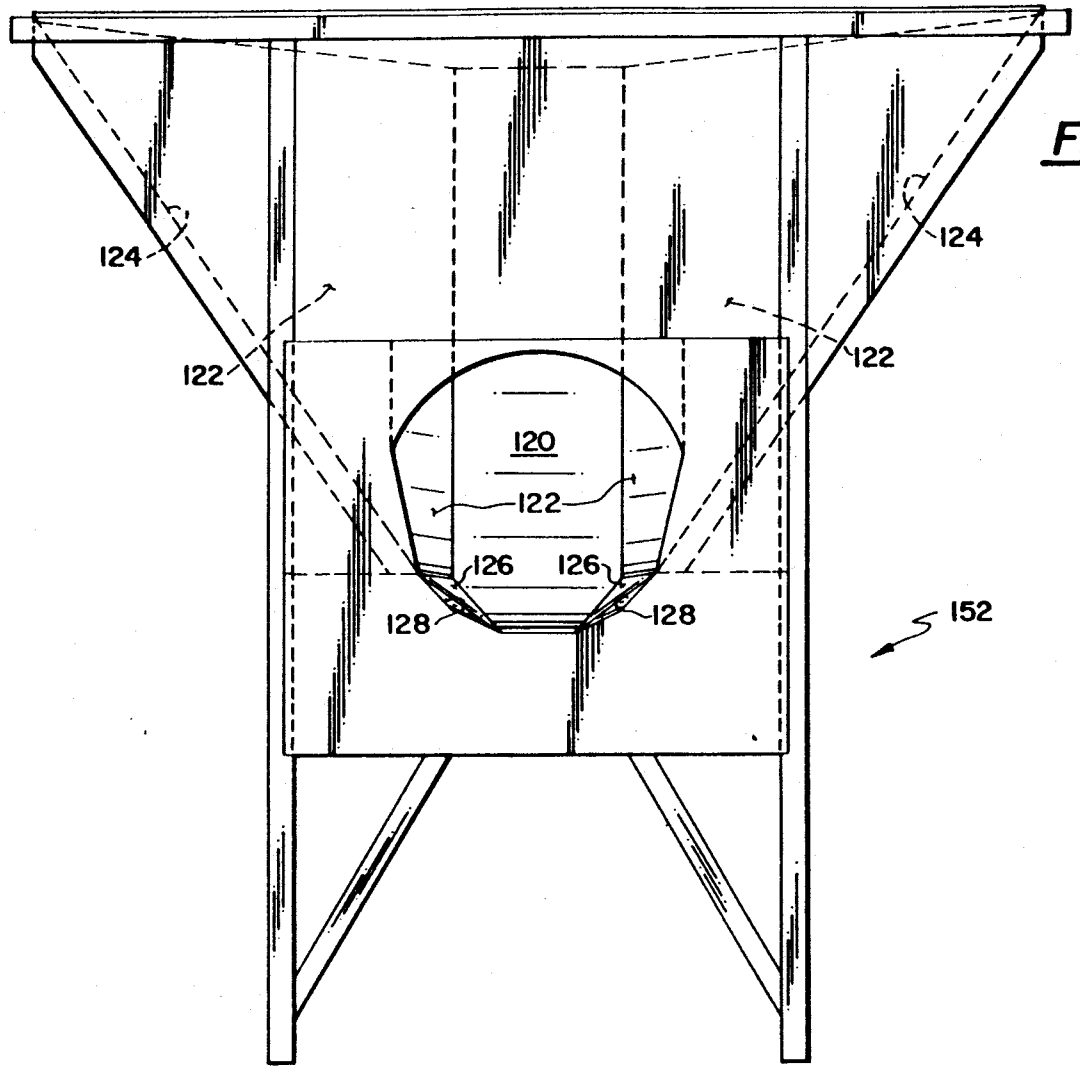
FIG. 13 is a cross-sectional view taken along line 13—13 of FIG. 9.

With reference to FIG. 13, and the top plan view of FIG. 9, in accordance with the present invention three substantially triangular infeed transition plates 126 128, and 130 are defined immediately adjacent the debarking drum inlet. This channels the logs from the trough, wing and central plates into the debarking drum 116. In the illustrated embodiment, the outermost transition plate 130 is in the form of a right triangle whereas the other two transition plates 126, 128 are obtuse triangles. In the prior art assembly on the other hand, it should be recalled, only two transition plates 26,28 were provided, one in form of an obtuse triangle 26 and the other being a quadrilateral plate 28.

Figure 8:
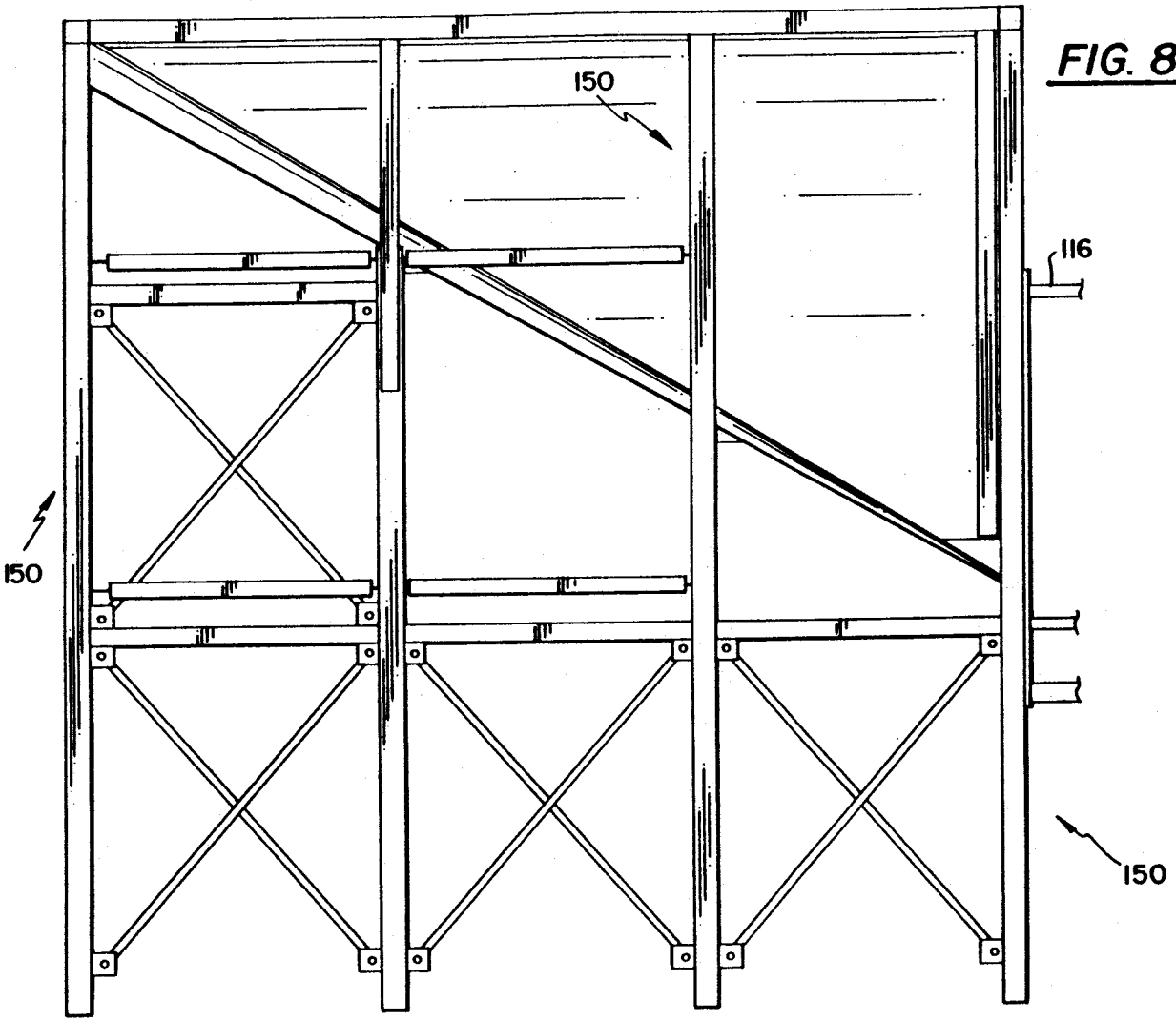
FIG. 8 is an elevational view of an infeed chute with wings for dual cranes in accordance with the invention.

As shown in FIGS. 8, 10, and 12, an outer frame assembly 150 is provided for the infeed chute 112 of the invention to support the wing walls or plates 124, to ensure the structural integrity of the structure. Thus, while the main frame assembly 152 does not differ significantly from that of the prior art infeed chute 12, additional wing support assemblies 150 are provided on each lateral side of the trough assembly at spaced locations along its length. In the illustrated embodiment, the wing support assemblies 150 are mounted at each longitudinal end of the chute and at a point two thirds of the way along the length.

Although dimensions of the infeed chute of the invention may be varied to accommodate the needs of a particular chip mill and crane arrangement and the particular size of the debarking drum without departing from the invention, by way of example, the illustrated infeed chute has a total length of about 33 feet and a width of about 34 feet. Furthermore, the chute has a height of about 35½ feet to accommodate a drum which has a centerline about 19 feet above ground. For infeeding that drum, the outlet of the plates of the chute is about 14½ feet above ground. At the inlet end of the chute, the central plate 120 is about two feet below the top edge of the chute. Finally, in the illustrated embodiment, the debarking drum has an inner diameter of about ten feet.

Thus, the debarking infeed chute 112 provided in accordance with the present invention is capable of accommodating infeed from two log cranes 110,111 simultaneously or nearly simultaneously by providing a central feed plate 120 of relatively smaller width and trough plates 122 of greater width and at a lesser slope than in the prior art assembly thereby to provide a smoothly and slightly inclined trough. Furthermore, wing plates 124 are provided which not only define containing side walls but continue and extend the trough width and as such are of less severe vertical inclination than the prior art walls, again to receive a plurality of log loads and yet smoothly guide the same towards a common inlet. Desirably, to accommodate the gentle slope and increased width of the chute assembly, three transition plates are provided adjacent the debarker inlet to round out the flow thereinto.

While the invention has been described in connection with what is presently considered to be the most practical and preferred embodiment, it is understood that the invention is not limited to the disclosed embodiment, but, on the contrary, is intended to cover various modifications and equivalent arrangements included within the spirit and scope of the appended claims.

What is claimed is:

1. An infeed chute having an inlet end; an outlet end disposed adjacent a debarking drum of predetermined width; and a plurality of plate elements defining a vertically decending path from said inlet end to said outlet end, said plurality of plate elements including a central plate element having first and second lateral side edges, first and second substantially triangular trough plate elements, each said trough plate element having an inner side edge and an outer side edge, each said trough plate element being disposed with its inner side edge extending along a respective lateral side edge of said central plate element, and first and second substantially triangular wing plate elements, each said wing plate element being disposed along a respective outer side edge of a respective said trough plate element, each said trough plate element defining an angle C of greater than about 165 degrees with said central plate element, each said wing plate element defining an angle D of greater than about 125 degrees with a respective said trough plate element, whereby logs to be debarked can be received at least nearly simultaneously from two log cranes and guided into the debarking drum.

2. An infeed chute as in claim 1, wherein said trough plate elements have a first width adjacent said inlet end and a second width adjacent said outlet end, said first width being greater than said second width; and said wing plate elements have a first width adjacent said outlet end and a second width adjacent said inlet end, said first width being greater than said second width.

3. An infeed chute as in claim 1, wherein said central plate element has a width of about one-half that of the debarking drum.

4. An infeed chute as in claim 1, wherein adjacent said inlet end of the infeed chute, each of said trough plate elements has a width of about 1.2 times greater than that of the debarking drum inlet.

5. An infeed chute as in claim 1, further comprising a plurality of transition plates each coupled to at least one of said central, trough, and wing plate elements thereby to define a transition from an open, U-shaped trough to a part circular infeed for the debarking drum.

6. An infeed chute as in claim 5, wherein there are three transition plates provided on each longitudinal half of the chute.

7. An infeed chute as in claim 6, wherein two of said three transition plates of each side have an obtuse triangular shape and the third transition plate has a substantially right triangular shape.

8. An infeed chute as in claim 1, further comprising a sub-frame assembly for supporting said central plate element and said trough plate elements and a wing sub-frame assembly for supporting said wing plate elements, said wing sub-frame assembly being provided at spaced locations along the length of the wing plate elements.

9. An infeed chute as in claim 1, wherein said angle C is between about 170 and about 175 degrees.

10. An infeed chute as in claim 1, wherein said angle D is between about 125 and about 140 degrees.

* * * * *